US006234431B1

(12) United States Patent
Simhaee

(10) Patent No.: US 6,234,431 B1
(45) Date of Patent: May 22, 2001

(54) PLASTIC BAG DISPENSER AND SUPPORT MECHANISM THEREFORE

(76) Inventor: Ebrahim Simhaee, 112 N. Maple Dr., Beverly Hills, CA (US) 90210

( * ) Notice: Subject to any disclaimer, the term of this patent is extended or adjusted under 35 U.S.C. 154(b) by 0 days.

(21) Appl. No.: 09/261,837

(22) Filed: Mar. 3, 1999

Related U.S. Application Data

(62) Division of application No. 09/036,818, filed on Mar. 9, 1998.

(51) Int. Cl.[7] ..... A45D 19/04
(52) U.S. Cl. ..... 248/127; 248/118
(58) Field of Search ..... 248/127, 121, 248/415, 418, 425, 278.1, 289.11, 291.1, 292.12, 118

(56) References Cited

U.S. PATENT DOCUMENTS 1,213,127 * 1/1917 Osborne et al. ..... 248/127
3,384,334 * 5/1968 Malachowski ..... 248/289.11
3,724,798 * 4/1973 Lucasey ..... 248/418
5,918,840 * 7/1999 Christensen ..... 248/118

* cited by examiner

*Primary Examiner*—Anita M. King
*Assistant Examiner*—Kimberly Wood
(74) *Attorney, Agent, or Firm*—Darby & Darby

(57) ABSTRACT

A device for supporting a plastic bag dispenser on a pivotable supporting surface such as a European table, comprises a bracket having transverse plates, one of which is adapted to be attached to the supporting surface. The other plate has a center hole and a series of circumferential holes equally spaced around the center hole. A mounting bar is attached at one of its ends to the second plate by fasteners which extend through the center hole and one of the circumferential holes so that the relative position of the mounting bar can be varied depending on a selection of circumferential holes. A mounting plate is attached to the opposite end of the mounting bar and includes an aperture and a series of spaced openings which receives complementary projections on the plastic bag dispenser to retain the dispenser. Additional fastener means extend through the aperture and a base plate of the dispenser for securing the dispenser to the mounting plate.

1 Claim, 4 Drawing Sheets

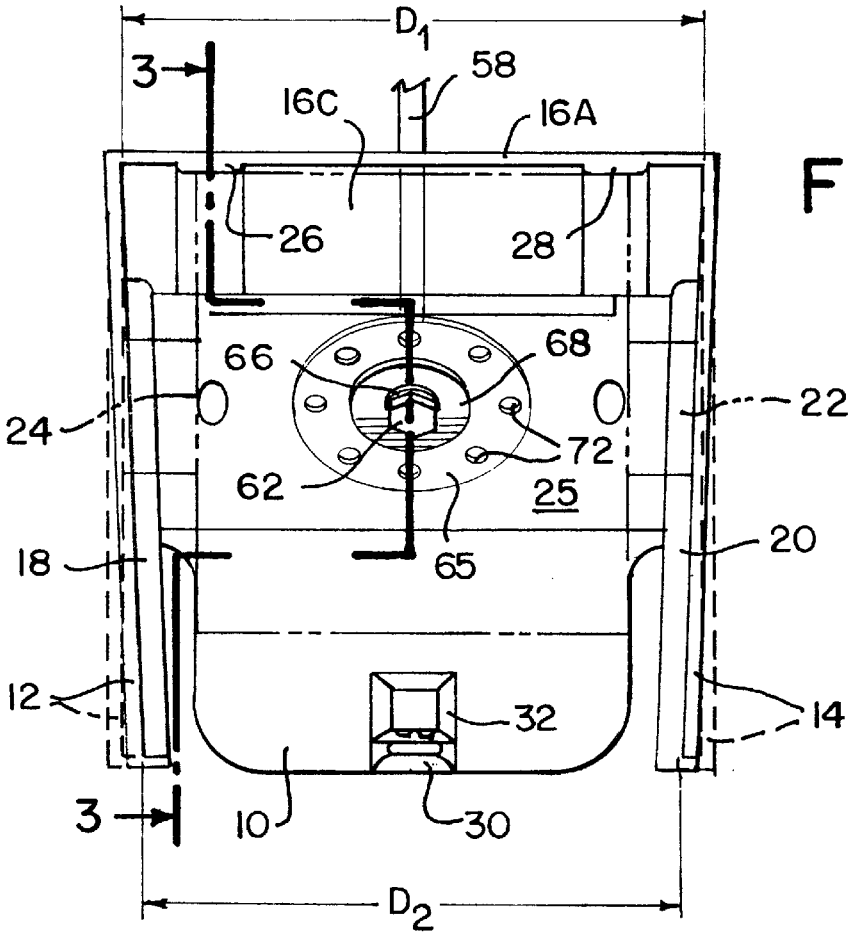
FIG. 2
FIG. 4
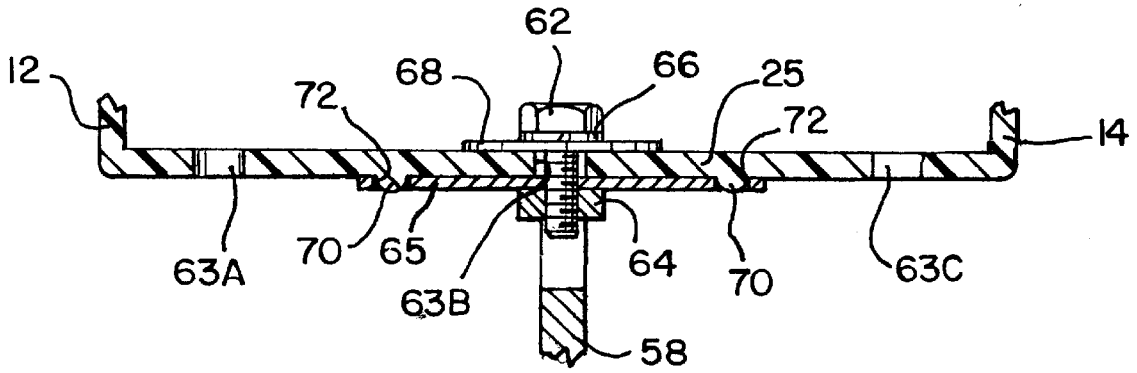

FIG. 5
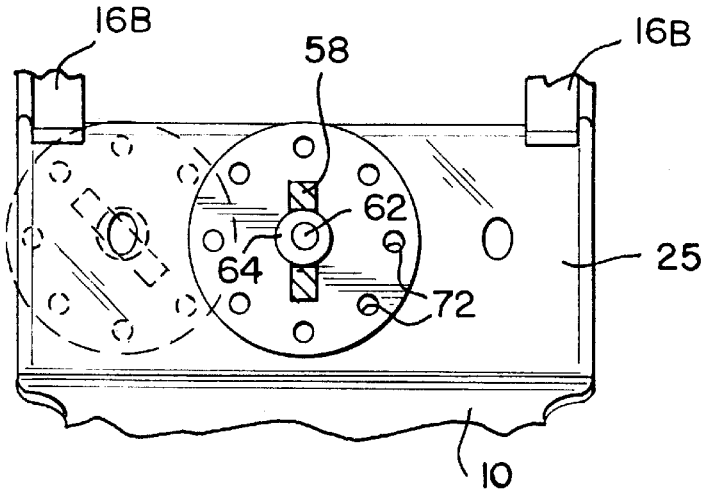
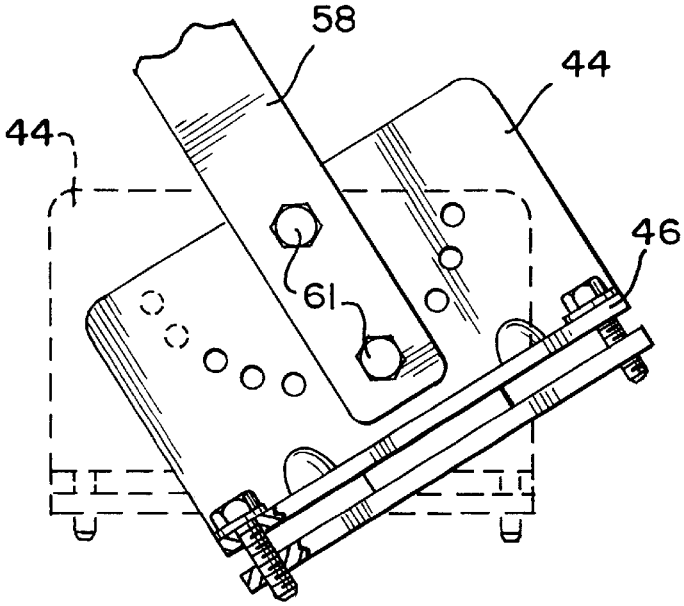
FIG. 6
FIG. 7
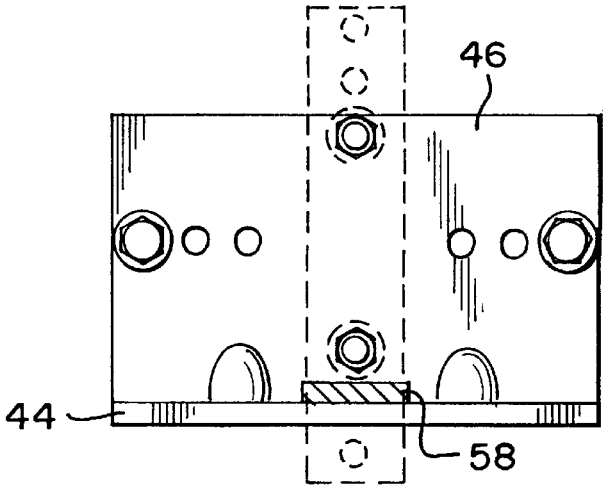

PLASTIC BAG DISPENSER AND SUPPORT MECHANISM THEREFORE

This application is a division of application Ser. No. 09/036,818 filed Mar. 9, 1998, the entire disclosure of which is hereby uncorporaed herein by reference.

This invention relates to a device for dispensing articles from a roll of continuous articles. Specifically, the invention relates to plastic bag dispensers and devices for mounting such dispensers on pivotable surfaces of the type commonly found in grocery stores.

BACKGROUND OF THE INVENTION

U.S. Pat. No. 5,558,262 dated Sep. 24, 1996 and entitled "Plastic Bag Dispenser" (hereinafter the '262 patent) illustrates a number of different plastic bag dispensers wherein plastic bags can be dispensed and separated from a roll of bags. In the embodiment of the dispenser shown in FIGS. 13–18 of the '262 patent, a braking force is applied to the roll by friction due to the weight of the roll. The axle, which supports the roll, sits in opposing tracks which are shaped so that the component of force which causes the friction increases as the roll is depleted. The object is to provide a braking force which, regardless of the size of the roll, is not so great as to prevent rotation of the roll in normal use yet will provide sufficient braking force when the roll is small to prevent free wheeling of the roll. In the illustrated embodiment, a separate friction roller is used to brake the roll when the roll is almost depleted. U.S. Pat. No. 5,558,262 is hereby incorporated by reference into this application.

The present invention provides a dispenser of the type shown in the '262 patent wherein the use of a friction roller is not required to retard or brake rotation of the roll when its diameter is small.

The dispenser of the '262 patent is designed to be mounted in a particular orientation. If the orientation of the dispenser is changed significantly, the braking force may become greater or less than desired. Proper orientation of the dispenser is not a problem if the dispenser is mounted on a stationary surface but it is becoming increasingly common in grocery stores for produce to be offered to customers on what are known as "European tables". These are tables in which the surface is pivotable by raising the back of the table. If a plastic bag dispenser as shown in the '262 patent is fixed to such a table, its orientation will not be optimal for all table positions.

Accordingly, a further object of this invention is to provide a dispenser support for use with a pivotable supporting surface which can be easily adjusted to maintain the dispenser in its optimal orientation for all positions of the supporting surface.

THE DRAWINGS

FIG. 2 is a plan view of the dispenser;

FIG. 4 is a sectional view along the line 4—4 of FIG. 3 showing how the dispenser is attached to the support mechanism;

FIG. 5 is a sectional view along the line 5—5 of FIG. 3;

FIG. 6 is a partial side plan view showing how the support mechanism can be adjusted to accommodate the angle of the supporting surface;

FIG. 7 is a sectional view along the line 7—7 of FIG. 3.

SUMMARY OF THE INVENTION

Figure 1:
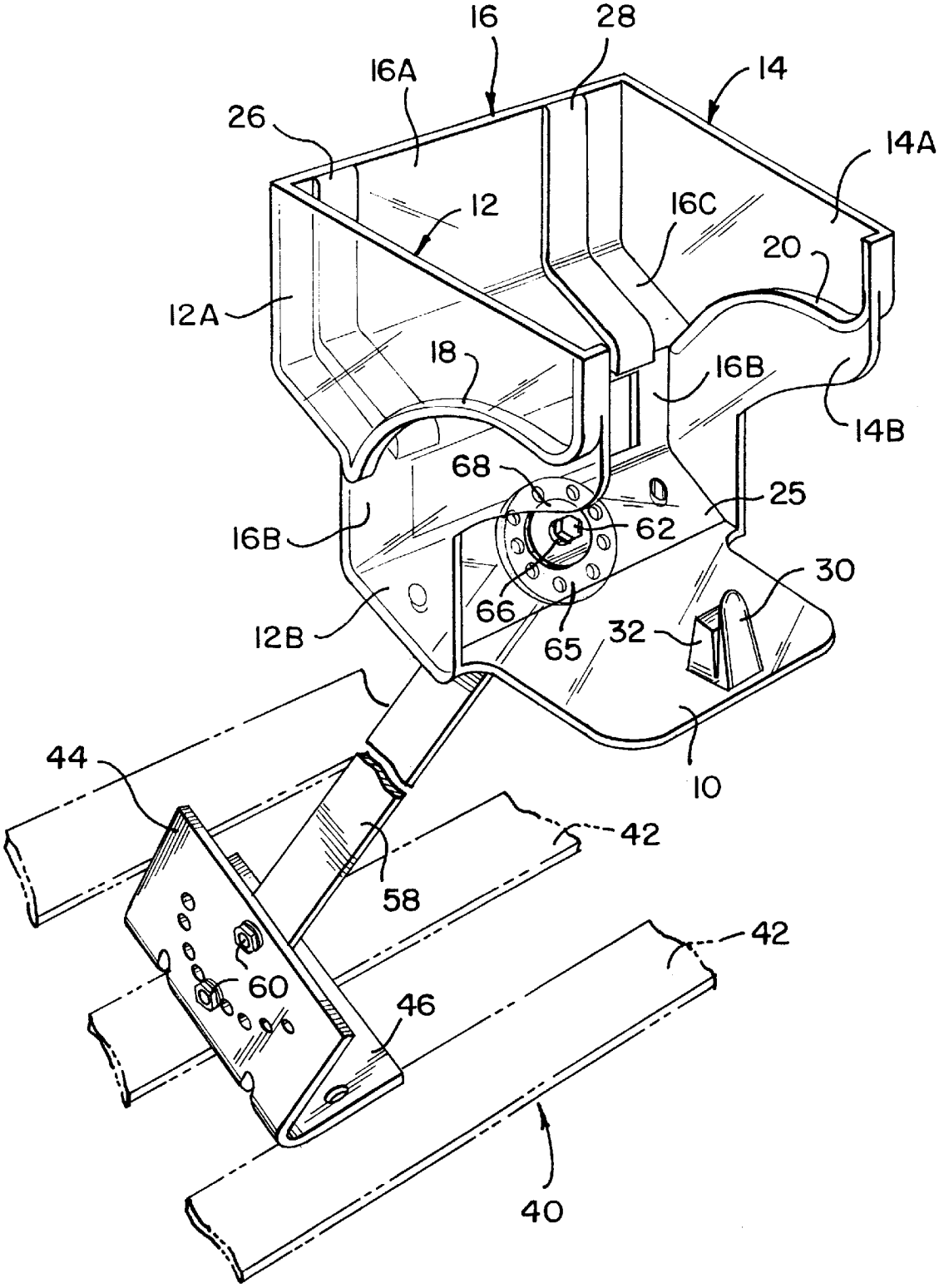
FIG. 1 is a perspective view showing the support and plastic bag dispenser in accordance with a preferred embodiment of the invention.

Briefly, in accordance with the invention, a dispenser for use with a roll of separable articles mounted on an axle, comprises a container for holding the roll, the container including a surface which frictionally engages the roll to apply a braking force to the roll as the articles are dispensed. The axle on which the roll is mounted rides in opposing tracks in the dispenser whereby the roll gradually falls in the tracks to the bottom of the container as the articles are dispensed. The tracks are bound by spring loaded elements (for example, the walls of the dispenser in which the tracks are formed) which apply an additional braking force to the ends of the roll.

In accordance with a further feature of the invention, a support is provided for mounting a dispenser or other such device on a pivotable supporting surface. The support includes a bracket having transverse plates one of which is adapted to be connected to the supporting surface. The other plate has a center hole and two or more circumferential holes equally spaced from the center hole. A mounting bar is attached at one end to the bracket by means of fasteners which extend through the center hole and a selected one of the circumferential holes so as to enable orientation of the mounting bar depending on the angle of the supporting surface. A mounting plate is connected to the upper end of the mounting bar and engages a complementary supporting surface on the dispenser.

DETAILED DESCRIPTION

According to a preferred embodiment, the dispenser comprises a container which includes a bottom wall 10, side walls 12 and 14, and a back wall 16. The side wall 12 and 14 each include upper sections 12A, 14A and lower sections 12B and 14B. The upper and lower sidewall sections are offset by curved guide flanges 18 and 20 which form the curved tracks which support a roll of plastic bags 24 wound on an axle 22. (see FIG. 3). The configuration of the preferred roll and axle is shown in the '262 patent. An angled mounting panel 25 connects the bottom wall 10 to back wall 16.

The back wall 16 includes top and bottom vertical sections 16A and 16B separated by a sloped section 16C. Two spaced apart ribs 26 and 28 extend across back wall sections 16A and 16C and provide the surfaces which brake the rotation of the roll 24 as the individual bags are dispensed.

Figure 3:
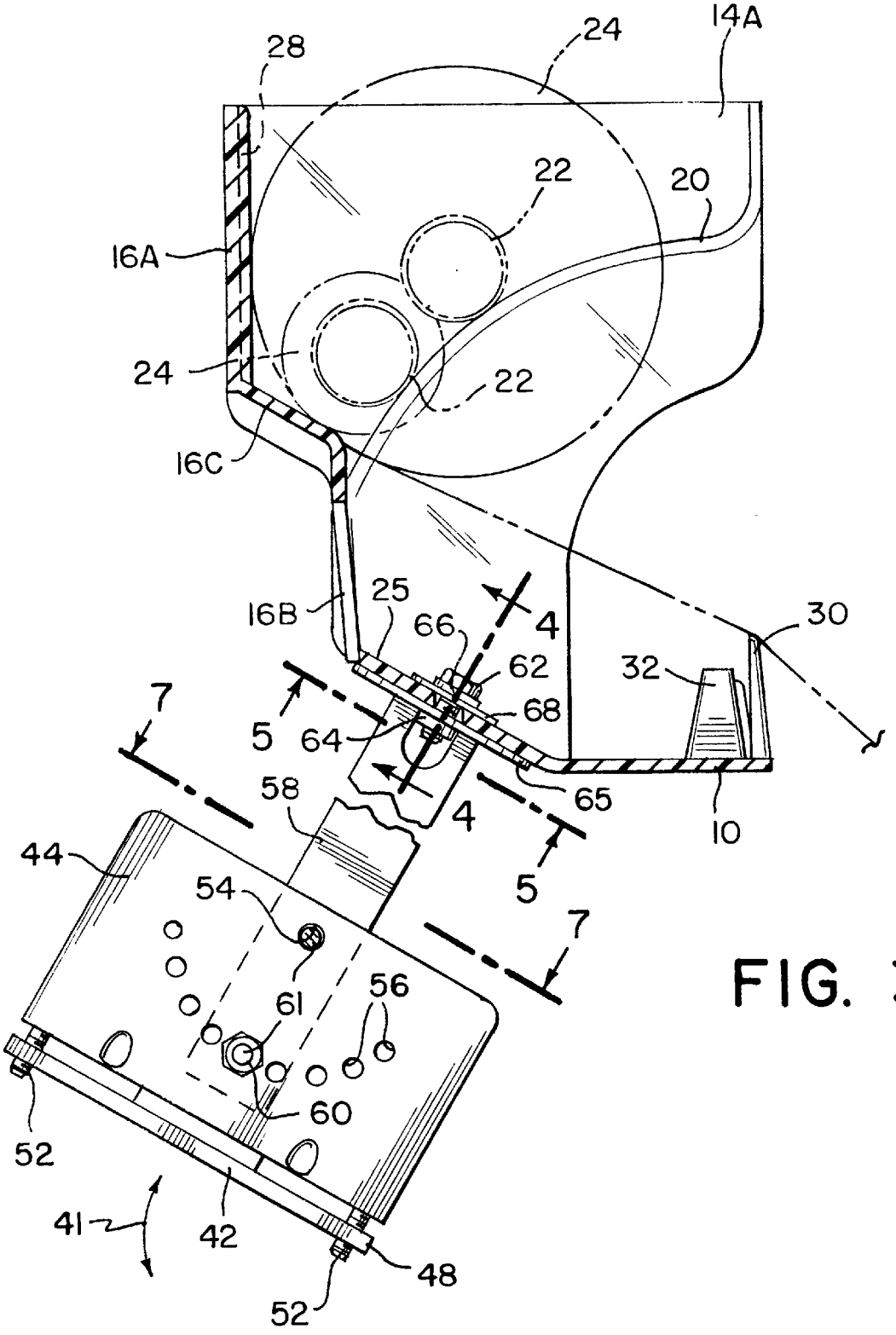
FIG. 3 is a side sectional view along the line 3—3 of FIG. 2.

The angled relationship between the back wall sections 16A and 16C service an important functional purpose. As shown in FIG. 3, when the roll 24 is large it engages both wall sections. However, as the roll is depleted, causing it to drop on the tracks formed by the flanges 18 and 20, it contacts only the sloped back wall section 16C. In the '262 patent, which does not include a sloped wall section comparable to section 16C, it is necessary to use a separate friction roller to create a frictional braking force. Here, however, because of the configuration of the back wall, the use of a friction roller is not required. As in the '262 patent, separation of the bags is caused by engagement of the central slot in the separation line between adjacent bags and a tongue 30 which cooperates with a finger 32 to facilitate separation of the bags.

The dispenser may be molded from a suitable plastic material such as polycarbonate which is strong, sturdy and flexible although the material selected is not a feature of this invention. Other materials, such as steel rod, may also be used. As shown in FIG. 2, the side walls 12 and 14 are angled slightly toward each other. This angle is selected so that when the roll of bags is placed in the container, with the projecting ends of axle 22 resting on the flanges 18 and 20, the upper side wall section 12A and 14A are slightly spring biased toward each other thereby applying pressure to the ends of axle 22, which is slightly longer than the distance between the upper side wall sections 12A and 14A.

The construction thus provides two braking forces to the roll as the bags are dispensed. The first is caused by friction between ribs 26 and 28 and roll 24 due to the weight of the roll. As in the '262 patent, because of the shape of the flanges 18 and 20, the relative frictional force component increases as the roll is depleted. The second braking force is supplied by the pressure exerted by the spring biased upper side wall sections 12A and 14A against the ends of the axle 22. This additional force becomes the primary braking force as the roll diminishes during use.

As shown in FIG. 2, the side walls 12 and 14 converge which means that the distance between the tracks in which the roll rides increases as the plastic bags are dispensed and the roll drops in the tracks. This is an important feature of the invention because it means that the force applied to the core by the spring biased side walls when the roll is full (and the core is furthest from the back wall 16) is less than the force applied by the spring biased side walls when the roll is depleted (and the core moves closer to the back wall 16). The effect of this is to increase gradually the force applied to the core by the spring biased side walls as the bags are dispensed. Since the weight of the roll diminishes as the plastic bags are dispensed, which reduces the braking force due to friction between the roll and the back wall 16, the increased force due to the spring biased side walls compensates for the reduced frictional forces as the roll is depleted.

Referring to FIG. 2, and as an example, if the length of the core is 5.15 inches, the distance D1 may be 5.25 inches and the distance D2 4.85 inches. Because the distance between the tracks near the rear wall 16 is greater than the length of the core, the core theoretically could reach a point where no force is applied to it by the side walls. If that were to happen, the retarding force on the core would be so low that the roll would free wheel. The ribs 26 and 28 on the back wall portion 16C prevent the roll from dropping to a point where free wheeling can occur.

Although the precise position of the dispenser in use is not critical, it is preferred that the dispenser be mounted with the bottom wall 10 horizontal as shown in FIG. 3. The support mechanism shown in the drawings enables this result.

FIG. 1 shows a typical "European table" 40 which consists of spaced slats 42 secured by two or three cross slats (not shown). The table 40 can be pivoted in the direction of arrow 41 (FIG. 3) which would alter the orientation of the dispenser if its position were fixed relative to the table.

In accordance with this aspect of the invention an L-shaped bracket is provided which includes transverse plates 44 and 46 (FIG. 1). The plate 46 overlies one of the slots 42 and is held in place by a retaining plate 48 (FIG. 3) and suitable fastener means such as bolts 52 which engage threaded holes (not numbered) in the retaining plate 48.

The upstanding bracket plate 44 includes a center hole 54 and a plurality (nine, in the illustrated embodiment) of circumferential holes 56 each spaced the same distance from center hole 54. A mounting bar 58 can be attached to the bracket plate 44 in various different angular relationships by nuts 60 and bolts 61 (for example) which pass through center hole 54, a selected one of the circumferential holes 56, and corresponding holes (not numbered) in mounting bar 58. The dispenser includes three apertures 63A, 63B and 63C (FIG. 4), any one of which can be used to secure the dispenser to the mounting bar 58. The upper end of the mounting bar 58 supports a circular mounting plate 65 which engages the undersurface of the dispenser mounting panel 25 and is retained by a bolt 62 extending through aperture 63B, nut 64, lock washer 66 and washer 68. Projections 70 on the undersurface of dispenser panel 25 engage complementary apertures 72 in mounting plate 65 to fix the dispenser relative to the mounting bar 58 after bolt 62 is tightened. The angular position of the dispenser relative to the mounting bar 58 can, of course, be varied, if desired.

I claim:

1. In combination, an article and a support for mounting the article on a pivotable supporting surface, the support comprising a bracket having transverse plates, one of the plates adapted to be attached to said supporting surface, the other plate having a center hole and at least two circumferential holes equally spaced from the center hole, a mounting bar attached at one of its ends to said other plate by fastener means extending through said center hole and one of said circumferential holes depending on the desired angle of said mounting bar relative to said other bracket plate, a mounting plate attached to the end of said mounting bar opposite said one end supporting said article, said mounting plate including an aperture and spaced openings recessing complementary projections on said article holding said article in a predetermined position relative to said mounting plate, and fastener means extending through said aperture for fastening said article to said mounting plate.

* * * * *